United States Patent [19]

Röhrig et al.

[11] 4,036,280

[45] July 19, 1977

[54] METHOD OF STARTING THE CASTING OF A STRAND IN A CONTINUOUS CASTING INSTALLATION

[75] Inventors: Adalbert Röhrig, Wadenswil; Fritz Willim, Birmensdorf, both of Switzerland; Brian Hannah, Kempton Park, Transvaal, South Africa

[73] Assignee: Concast AG, Zurich, Switzerland

[21] Appl. No.: 705,800

[22] Filed: July 16, 1976

[30] Foreign Application Priority Data

July 18, 1975 Switzerland ..... 9423/75

[51] Int. Cl.[2] ..... B22D 11/08

[52] U.S. Cl. ..... 164/82; 164/281 R; 222/594

[58] Field of Search ..... 164/82, 133, 274, 281 R; 266/272; 222/590, 591, 594, 600

[56] References Cited

U.S. PATENT DOCUMENTS

| | | | |
|---|---|---|---|
| 469,454 | 2/1892 | Rogers | 266/272 X |
| 1,184,523 | 5/1916 | Field | 164/133 |
| 3,623,534 | 11/1971 | Brennan | 164/82 |

FOREIGN PATENT DOCUMENTS

| | | | |
|---|---|---|---|
| 1,504,293 | 10/1967 | France | 164/274 |

*Primary Examiner*—Robert D. Baldwin
*Attorney, Agent, or Firm*—Werner W. Kleeman

[57] ABSTRACT

A method of, and apparatus for, starting-up the casting of a strand during continuous casting, wherein molten metal, typically steel, is teemed through a bottom pouring outlet or opening of a tundish at a throughflow rate essentially determined by the dimensions of the pouring opening, into a continuous casting mold. By means of the dummy bar head of a dummy bar there is formed a connection between the dummy bar and the solidified strand forming in the continuous casting mold and after reaching a predetermined bath level in the mold the strand is withdrawn. According to the invention the throughflow rate is maintained smaller during a predetermined time span between the beginning of teeming the metal into the continuous casting mold and reaching the predetermined bath level by melting a tubular-shaped meltable body which has been introduced into the pouring opening, and the melting time of the meltable body is accommodated to such predetermined time span by dimensioning and/or selecting the material of such meltable body.

7 Claims, 2 Drawing Figures

METHOD OF STARTING THE CASTING OF A STRAND IN A CONTINUOUS CASTING INSTALLATION

BACKGROUND OF THE INVENTION

The present invention relates to a new and improved method of starting-up the casting of a strand during continuous casting, wherein molten metal, typically steel, is cast or teemed through a bottom pouring opening of a tundish at a throughflow rate essentially governed by the dimensions of the bottom pouring opening, into a continuous casting mold, and there is formed by the dummy bar head of a dummy bar a connection between such dummy bar and the solidified strand and upon reaching a predetermined bath level in the continuous casting mold the strand is withdrawn. Further, the invention relates to a new and improved construction of apparatus for the performance of the aforementioned method.

During the continuous casting of steel and as a general rule when forming billet-and bloom-shapes, there are employed tundishes having open bottom pour openings. With such open bottom pour openings, which are neither equipped with a slide-nor a stopper-control, the throughflow rate of the cast metal can be influenced by different degrees of filling of the tundish. A further factor which affects the throughflow rate is the viscosity of the metal which is influenced by the casting temperature. However, the throughflow rate is essentially determined by the dimensions of the pouring outlet or opening.

During the start of casting a strand the mold outlet is closed by the dummy bar head of the dummy bar. This dummy bar head, which for instance can be a permenant dummy bar head, forms a connection with the solidified strand. The contemplated casting speed essentially determines the dimensions of the bottom pouring opening. Also resulting therefrom is the time needed to fill the mold during the start of casting. If a pouring outlet nozzle is provided for instance for a mold having the dimensions 200 mm× 200 mm for 600 kg steel per minute, i.e. for a casting speed of 2 meters per minute, then between the start of casting the steel into the mold and the beginning of strand withdrawal, for a filling height in the tundish of about 100 mm and a filling height of the mold of 600 mm, there are available between 28 to 34 seconds. This time which is available for the solidification of a coupling piece at the hot strand and the formation of a strand shell or skin which safeguards against metal breakouts oftentimes is not sufficient to insure that casting can be started without the danger of metal breakouts. By inserting the emergency launder the possibility exists of interrupting the casting operation for such length of time until there has been obtained the desired solidification. The insertion of the emergency launder is, however, not only quite dangerous due to the rather pronounced spraying of steel but furthermore the entire continuous casting installation is contaminated by the steel spatters. Additionally, the danger exists that the emergency launder will already have been soiled when real emergency situations arise and therefore will be impaired with respect to its functional reliability.

The drawbacks of the shorter starting casting times can be overcome by selecting a bottom outlet nozzle having a smaller diameter. By virtue of this measure there is however simultaneously reduced the speed and therefore the output of the continuous casting installation so that, for instance, it is no longer possible to carry-out sequential pours or to cast with large ladle capacities.

In order to maintain constant the outfeed rate even with decreasing fill height and decreasing temperature of the cast metal, it is known during block casting to employ casting nozzles having an inner cross-section which reduces in the direction of the outlet end. The casting nozzle protrudes in relation to the casting vessel, so that the length of the nozzle can be shortened by cutting-off parts thereof and thus there can be enlarged in a number of steps the outlet cross-section. The cutting operation is carried out by means of a clamp or pliers which are applied to preformed notches. During cutting it is impossible to avoid that some refractory particles will be flushed by the casting jet into the cast piece. When applying this technique for the continuous casting of strand such refractory particles will be washed directly into the metal bath of the continuous casting mold where, especially in the case of small cross-sections, they will become frozen in the strands shell or skin and can cause strand defects or breakouts. Due to breaking-off of a nozzle part there also will be damaged the edge of the nozzle mouth, disturbing the formation of a faultless casting jet and causing the known drawbacks.

Further, there is known to the art a pouring opening or outlet for casting ladles having an outflow quantity which changes as a function of the pouring or outflow time and which possesses an outflow channel widening in the outflow direction. The outflow channel is subdivided into a number of individual sections which, in the outflow direction, possess from section to section increased wear resistance of the refractory material. With such type pouring opening it is possible to achieve an automatic regulation within certain limits without the need for external action, especially when carrying out a casting operation under the exclusion of air. When using such outlet nozzle or opening at a tundish in a continuous casting installation refractory particles are flushed into the mold due to the errosive removal of the nozzle material, and thus the melt is contaminated. On the one hand, there is thus impaired the quality of the strand and, on the other hand, flushed-in refractory constituents can cause metal breakouts. Moreover, such regulation is extremely sluggish and cannot be utilized for influencing the throughflow rate within short time intervals.

SUMMARY OF THE INVENTION

Hence, it is a primary object of the present invention to provide an improved method of starting the casting of a strand in a continuous casting installation in a manner which is not associated with the aforementioned drawbacks and limitations of the prior art proposals.

Another and more specific object of this invention is to overcome the previously mentioned disadvantages and, particularly, to increase the time between the start of casting in a continuous casting mold and the start of withdrawal of the strand for tundish pouring outlets or openings which do not employ a stopper or slide, so that there can be avoided the start-up metal breakouts also in the case of short molds and/or when using permanent-dummy bar heads.

Now in order to implement these and still further objects of the invention, which will become more readily apparent as the description proceeds, the method aspects of this development are manifested by the features that the throughflow rate is maintained smaller during the time interval from the start of the casting operation in the mold until reaching the predetermined bath level by melting a tubular-shaped meltable body introduced into the pouring outlet or opening, and the melting time is accommodated to the predetermined time interval by dimensioning and/or selection of the material of the meltable body.

When utilizing the inventive method the desired duration of the time interval for the solidification of a sufficiently stable strand shell can be easily reached. The danger of start-up breakouts is thus practically eliminated in the case of short molds and/or when using permanent-dummy bar heads. Depending upon the dimensions of the meltable there can be exactly regulated and also maintained the desired time-delay with great accuracy, for instance to ten seconds. The dimensions of the bottom pouring outlet or opening can thus be accommodated to the maximum possible casting speed without considering the throughflow rate during this time interval. Further notable advantages in contrast to the state-of-the-art proposals are realized by virtue of the fact that during melting of the meltable body the metal bath in the mold is not contaminated by refractory constituents. The bottom pouring opening is self-cleaning without the need for a post-burning operation with the aid of an oxygen lance or the like.

The apparatus useful in the performance of the method is manifested by the features that the bottom pouring opening, at the start of casting, is provided with an insertable substantially tubular-shaped meltable body formed of metal. In order to avoid the danger of clogging the bottom outlet opening at the start of casting, it is advantageous if there is placed a cover over the pouring opening of the tundish. A further measure which can be resorted to is to pre-heat the bottom pouring opening or outlet together with the meltable body prior to pouring the steel into the tundish.

The meltable body can be fixedly clamped in the pouring opening or outlet nozzle, for instance by slightly compressing such into oval configuration. In this manner it can be secured within the pouring opening at any random elevational position. On the one hand, in order to simplify the insertion and, on the other hand, to be able to maintain the meltable body always at the same elevation, it is advantageous, according to a further aspect of the invention, to provide the bottom pouring outlet or opening with a support surface for the meltable body.

The prolongation of the time interval which is desired when starting the casting operation is essentially governed by the wall thickness of the tubular section constituting the meltable body. Advantageous start-up casting times were obtained if the cross-sectional area of the tubular section is dimensioned such that it amounts to 30% to 60% of the inner cross-section of the bottom pouring outlet or opening. The teachings of this development also recommend maintaining the length of the tubular section between 20 and 60 mm.

The reduction of the throughflow rate during the casting start-up time is additionally dependent upon the thermal conductivity and the melting temperature of the meltable body. It is possible to use meltable bodies formed of metal alloys or metal ceramic (so-called cermets), the melting point of which is greater than the casting temperature of steel. Such meltable bodies then dissolve by the action of the steel casting jet and there can be reached time-delays in the order of one to two minutes. The expressions "meltable body" or "melt body" or equivalent terminology as employed herein is intended to also encompass bodies which dissolve in the steel casting jet. Surprisingly it has been found that for the majority of fields of application there can be advantageously selected a meltable body formed of steel containing, by weight, 0.1% to 0.7% carbon.

With a small diameter of the pouring opening it can for instance be desired to reduce, on the one hand, the cooling effect of the meltable body during the first seconds and, on the other hand, to somewhat increase the time-delay. To achieve this result it is recommended, according to a further aspect of the invention, to provide the tubular section with a thin thermally insulating covering.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
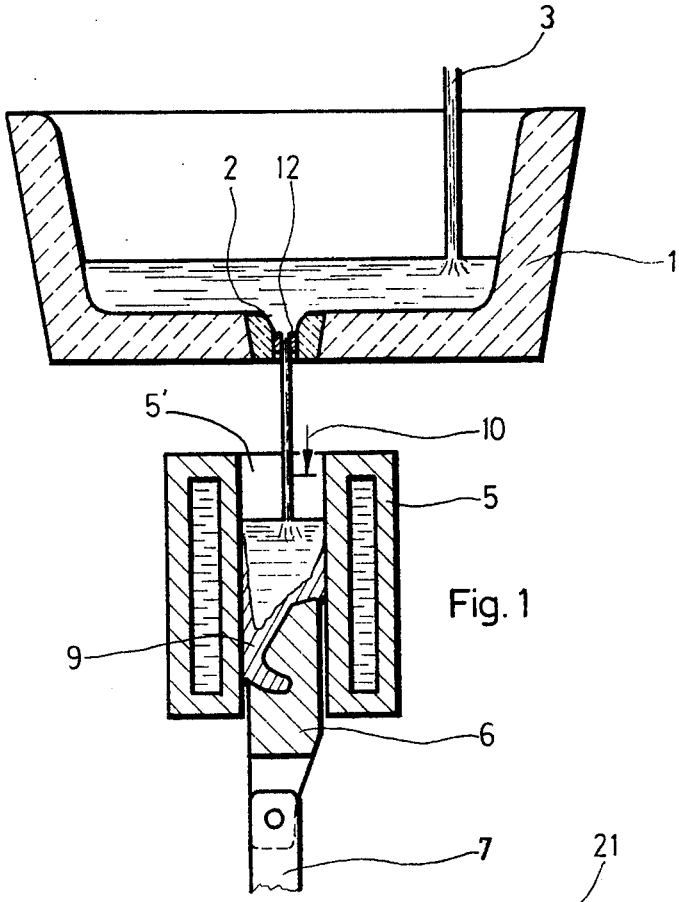
FIG. 1 is a cross-sectional view through a tundish and a continuous casting mold.

Describing now the drawings, it is firstly to be understood that to simplify the illustration only enough of the continuous casting installation or plant has been shown to enable those skilled in the art to fully understand the underlying concepts of the invention. Thus, in FIG. 1 there will be seen a casting vessel, here shown as a tundish 1 equipped with a bottom pourting opening or outlet 2. A teeming or casting jet 3 which emanates from a conventional and thus not particularly illustrated ladle supplies the tundish 1 with liquid steel. Now this steel flows through the outlet or opening 2, which is neither provided with a slide- nor a stopper- regulation device, into the hollow mold compartment or cavity of a continuous casting mold 5. At its outlet end the continuous casting mold 5 is closed by means of a dummy bar head 6 of a dummy bar 7. The dummy bar head 6 here constitutes a permanent dummy bar head, i.e. it forms due to its shape and without any additional coupling elements a coupling with the solidified hot strand 9. Reference character 10 designates a predetermined bath level in the mold 5. Prior to the start of the casting operation there is introduced into the pouring outlet or opening 2 a substantially tubular- shaped meltable body or melt body 12 defining a tubular section. This meltable body 12 constricts the throughflow cross-section of the bottom pouring outlet 2, whereby there is reduced the throughflow rate of such pouring outlet throughout a predetermined time interval. The aforementioned time interval begins with the start of casting the metal into the mold and terminates upon reaching the predetermined bath level designated by the arrow 10, at which instance the dummy bar 7 begins to move. The melting time of the meltable body 12 can be matched to the predetermined duration of the time interval by its dimensioning and/or the selection of the material from which it is formed.

Figure 2:
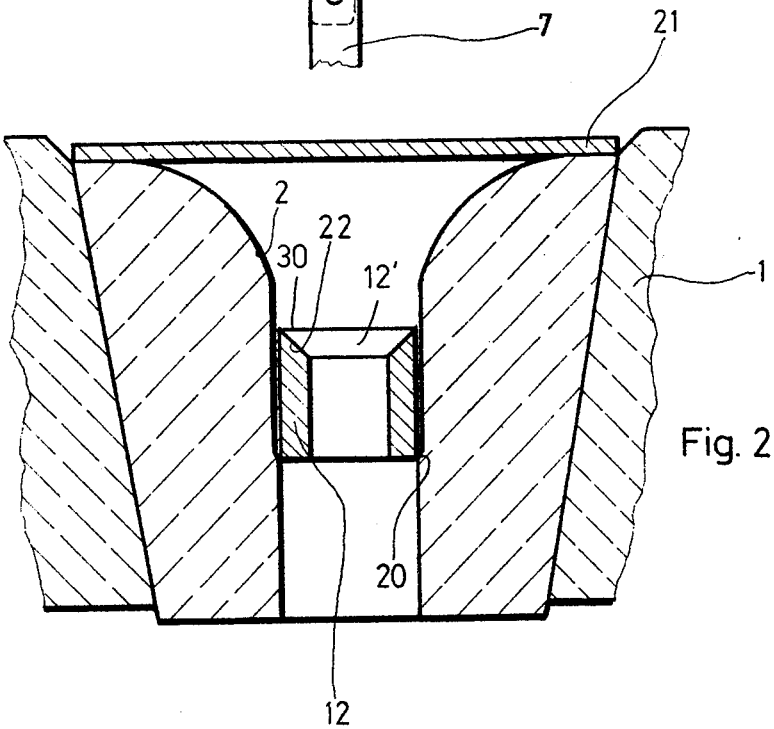
FIG. 2 is a cross-sectional view, on an enlarged scale, through the pouring opening of the tundish of FIG. 1.

In FIG. 2 there has been illustrated the pouring outlet 2 prior to the entry of steel into the tundish 1. The meltable body 12 bears against a support surface 20 of the pouring outlet 2. Inserted above the pouring outlet 2 is a sheet metal cover plate 21. This cover plate 21 prevents that the first cold steel flowing into the tundish 1 will flow to the pouring outlet 2 and clog such. This cover plate 21 is dimensioned such that upon there being present a steel bath level of several centimeters in the tundish 1 it will then melt. Instead of using the cover plate 21 it would also be possible to use to advantage asbestos plates or other means which prevent the entry of steel into the pouring outlet or opening 2 during a predetermined time.

The throughflow rate of the pouring outlet 2 is essentially governed by its dimensions. The meltable body 12 can be dimensioned such that its cross-sectional surface or area amounts to about 30% to 60% of the inner cross-section of the pouring outlet or opening 2. The height of the meltable body 12 can amount to 20 to 60 mm. At its inlet side 12' there is advantageously provided a beveled portion 22 for improving the formation of the casting or teeming jet. As a general rule the desired increase of the time interval can be obtained when using meltable bodies 12 formed of commercially available steel containing 0.1% to 0.7% carbon. When using a shorter mold 5 or a permanent dummy bar head 6, which requires a certain volumetric space within the mold, as well as when casting very small strand cross-sections, it can be desirable to provide the meltable body with a thin thermally insulating covering, as has merely been schematically indicated by reference character 30. Such insulating covering may be formed of, for instance, a layer of zirconium and can be applied with a brush although other known coating techniques can be employed.

The starting of casting steel into a mold for a bloom cross-section having, for instance, the dimensions 200 mm × 200 mm, and which should be cast at a casting speed of two meters per minute, proceeds according to the invention in the following manner: the required throughput of 600 kg steel per minute is attained with a reference bath level of 500 mm in the tundish 1 which possess a bottom pouring opening or outlet 2 of 24 mm diamter. The mold compartment 5' above the dummy bar head 6 has a filling height of about 500 mm and when using this pouring opening or outlet fills within a time span of 23 to 25 seconds, provided that during this time interval the bath level in the tundish only amounts to between 150 and 200 mm. In order to reduce the throughflow rate i.e. to increase the time interval, there is inserted into the bottom pouring opening or outlet 2 the tubular-shaped meltable body 12 having an external diameter of 24 mm and an internal diameter of 17 mm and a length of 30 mm. In conventional manner the tundish 1 together with the meltable body 12 is heated. Prior to casting the steel the cover plate 21 is placed over the pouring opening 2. As soon as during casting the steel bath in the tundish 1 has reached a height of, for instance, 10 cm, then the cover plate 21 melts. Steel flows into the mold 5 through the opening 2, the cross-sectional area of which has been constricted by about 50% by the meltable body 12. The time interval between the start of casting metal into the mold and reaching the predetermined molten bath level indicated by the arrow 10 is slowed down to 35 to 40 seconds by the action of the meltable body 12, corresponding to an increase of about 52% to 60% in relation to the above-mentioned 23 to 25 seconds. At the end of this time interval the meltable body has melted or, —what also can be desired— such body melts shortly after such time interval, with the result that there is now insured the throughflow quantity of 600 kg/min needed for the contemplated casting speed of 2 meters per minute.

While there is shown and described present preferred embodiments of the invention, it is to be distinctly understood that the invention is not limited thereto, but may be otherwise variously embodied and practiced within the scope of the following claims. Accordingly,

What is claimed is:

1. A method for starting-up the casting of a continuously cast strand, comprising the steps of:

a. providing a continuous casting mold equipped with a dummy bar having a dummy bar head for starting-up the continuous casting of a molten metal;

b. providing a tundish having a bottom pouring outlet;

c. prior to the start of casting inserting at least one meltable body into the bottom pouring outlet of the tundish to effect partial reduction in the cross-sectional area of said outlet;

d. teeming the molten metal from the tundish into the continuous casting mold;

e. reducing the throughflow rate of the molten metal teemed from the tundish into the continuous casting mold by means of the meltable body during a time interval lasting from the start of teeming the molten metal into the continuous casting mold until reaching a predetermined level of the molten metal in the continuous casting mold while melting the meltable body inserted into the bottom pouring outlet; and f. accommodating the melting time of the meltable body to said time interval by selecting any one of at least its dimensions, the material from which it is formed, or both.

2. The method as defined in claim 1, including the step of using as the meltable body a substantially tubular-shaped body.

3. The method as defined in claim 1, further including the step of withdrawing the cast strand together with the dummy bar after expiration of said time interval.

4. The method as defined in claim 1, including the step of reducing the throughflow in the order of 10% to 60% in relation to the throughflow rate prevailing without the use of the meltable body.

5. The method as defined in claim 1, further including the step of placing a cover over the pouring outlet of the tundish.

6. The method as defined in claim 1, further including the step of preheating the pouring outlet together with the meltable body prior to casting the metal into the tundish.

7. A method for starting casting of a continuously cast strand, comprising the steps of:

a. providing a continuous casting mold for the continuous casting of a molten metal equipped with starter means closing the outlet opening of said mold;

b. providing a tundish having a pouring outlet;

c. prior to the start of casting inserting at least one meltable body into the pouring outlet of the tundish to effect partial reduction in the cross-sectional area of said pouring outlet;

d. teeming molten metal from the tundish into the continuous casting mold; and e. reducing the throughflow rate of the molten metal teemed from the tundish into the continuous casting mold by means of the meltable body during a time interval lasting from the start of teeming the molten metal into the continuous casting mold until reaching a predetermined level of the molten metal in the continuous casting mold when melting the meltable body inserted into the bottom pouring outlet.

* * * * *